United States Patent [19]

Paul et al.

[11] 4,372,616

[45] Feb. 8, 1983

[54] METHOD FOR RESTORING FORMATION PREVIOUSLY LEACHED WITH AN AMMONIUM LEACH SOLUTION

[75] Inventors: James M. Paul; Wilton F. Espenscheid, both of DeSoto, Tex.

[73] Assignee: Mobil Oil Corporation, New York, N.Y.

[21] Appl. No.: 221,728

[22] Filed: Dec. 31, 1980

[51] Int. Cl.[3] ..... E21B 43/28

[52] U.S. Cl. ..... 299/5

[58] Field of Search ..... 166/275, 305 R, 307; 299/4, 5; 423/15, 17, 20, 261

[56] References Cited

U.S. PATENT DOCUMENTS

| | | | |
|---|---|---|---|
| 4,079,783 | 3/1978 | Snavely et al. | 299/4 X |
| 4,114,693 | 9/1978 | Foster et al. | 299/4 X |
| 4,134,618 | 1/1979 | Kossack | 299/5 |
| 4,155,982 | 5/1979 | Hunkin et al. | 299/4 X |
| 4,278,292 | 7/1981 | Yan et al. | 299/5 |
| 4,300,860 | 11/1981 | Yan | 299/5 |

*Primary Examiner*—Stephen J. Novosad
*Assistant Examiner*—George A. Suchfield
*Attorney, Agent, or Firm*—Charles A. Huggett; Michael G. Gilman; John K. Abokhair

[57] ABSTRACT

A method is disclosed for restoring to environmentally acceptable levels the ammonia content in a subterranean formation which has been previously subjected to in situ oxidative leaching employing an ammonium leach solution by flushing the formation with carbonic acid.

3 Claims, No Drawings

METHOD FOR RESTORING FORMATION PREVIOUSLY LEACHED WITH AN AMMONIUM LEACH SOLUTION

FIELD AND BACKGROUND OF THE INVENTION

This invention relates to techniques for restoring subterranean formations which have been subjected to in situ leaching of uranium values.

Recovery of uranium values from subterranean formations involves in the usual methods the oxidation of insoluble tetravalent uranium into soluble uranyl complexes that may be drawn from the formation by leaching. The overall reaction in oxidative in situ leaching may be described as follows:

$$UO_2(S)+[O]+3HCO_3^- \rightarrow UO_2(CO_3)_3^{-4}+H^+$$

As the source of carbonate ion, ammonium carbonate or ammonium bicarbonate is often used in the leach solution. Unfortunately, this results in the formation being contaminated with ammonium ions, thereby producing the potential of water pollution through contamination of aquifers flowing in or near the formation, as follows:

$$(NH_4)_2CO_3+\text{Ca-clay} \rightarrow NH_4\text{-clay}+CaCO_3$$

Following uranium leaching with ammonium solutions, restoration of the formation therefore must be undertaken. The most economical method of restoration consists of flushing the formation with fresh water. While this process continually leaches ammonia from the clay surfaces, it generally involves a long and sometimes incomplete restoration.

SUMMARY AND DETAILED DESCRIPTION OF THE INVENTION

A method has now been found for restoring a subterranean formation which has been previously subjected to in situ oxidative leaching with an ammonium leach solution by flushing the formation with carbonic acid. The carbonic acid may be produced in situ by adding carbon dioxide gas to an aqueous restoration fluid. The process can be carried out by adding carbon dioxide gas, for example, to the restoration fluid (e.g. water) in order to lower the pH to below 7. A moderate carbonate concentration is produced.

It has been found in connection with this invention that the carbonic acid solution comprising the restoration fluid dissolves calcite in the formation, which may either have been naturally occurring or precipitated during the leaching operation. Dissolution of the calcite results in a high calcium ion concentration buildup during circulation of the restoration fluid.

$$CaCO_3(S)+CO_2+H_2O \rightleftharpoons Ca^{+2}+2HCO_3^-$$

It has also been found in connection with this invention that the calcium ion in solution will readily exchange for the ammonium ion on the clay surfaces.

$$Ca^{+2}+2HCO_3^-+2NH_4\text{-clay} \rightarrow Ca\text{-}2(\text{clay})+2NH_4^++2HCO_3^-$$

Thus, a rapid removal of ammonia and restoration of the subterranean formation results.

The foregoing description of the invention has been directed to particular details in accordance with the requirements of the Patent Act and for purposes of explanation and illustration. It will be apparent, however, to those skilled in this art that many modifications and changes may be made without departing from the scope and spirit of the invention. It is further apparent that persons of ordinary skill in this art will, on the basis of this disclosure, be able to practice the invention within a broad range of process conditions. It is our intention in the following claims to cover all such equivalent modifications and variations as fall within the true scope and spirit of our invention.

What is claimed is:

1. A method for restoring to environmentally acceptable levels the ammonium ion content in a subterranean formation that has been subjected to in situ oxidative leaching with an ammonium leach solution which comprises passing through said formation a restoration fluid containing carbonic acid.

2. The method of claim 1, wherein said oxidative leaching is carried out in uranium-bearing formations containing calcium carbonate minerals associated with said uranium.

3. The method of claim 1 or 2, wherein said carbonic acid is produced in situ by adding carbon dioxide gas to an aqueous restoration fluid.

* * * * *